US005573652A

United States Patent [19]

Kiyama et al.

[11] Patent Number: 5,573,652

[45] Date of Patent: Nov. 12, 1996

[54] APPARATUS FOR CONTINUOUSLY DISSOLVING METAL POWDER FOR USE IN PLATING AND METHOD OF DISSOLVING NICKEL METAL USING SAME

[75] Inventors: Syuji Kiyama; Osamu Shin; Kaoru Mizumoto; Takashi Sekita; Hiroshi Ogaki; Akio Sakurai; Takao Ikenaga; Ichiro Tanokuchi; Naoki Sakai, all of Okayama, Japan

[73] Assignee: Kawasaki Steel Corporation, Hyogo, Japan

[21] Appl. No.: 395,971

[22] Filed: Feb. 28, 1995

[30] Foreign Application Priority Data

Feb. 28, 1994 [JP] Japan ..... 6-029467
Sep. 28, 1994 [JP] Japan ..... 6-233194

[51] Int. Cl.[6] ..... C25B 15/00; C25D 21/06; C25D 21/16; C25D 21/18

[52] U.S. Cl. ..... 205/98; 205/99; 205/101; 204/238; 204/240

[58] Field of Search ..... 204/235, 238, 204/240; 205/98, 99, 101

[56] References Cited

U.S. PATENT DOCUMENTS 1,980,381 11/1934 Cain ..... 204/235

FOREIGN PATENT DOCUMENTS 041796 2/1994 Japan .

*Primary Examiner*—Kathryn Gorgos
*Assistant Examiner*—Edna Wong
*Attorney, Agent, or Firm*—Staas & Halsey

[57] ABSTRACT

An apparatus for continuously dissolving metal powder for use in plating includes a dissolving tank for dissolving metal powder for used in plating solution in a solvent, a filter for separating the solution containing undissolved residue into an undissolved residue and a filtrate, a recovery tank of the filtrate, and a plating solution storing tank for supplying recovered filtrate to a plating tank. The filter is a porous substance having a plurality of liquid passages in the axial direction thereof, and the filter is provided with a circuit for returning a liquid solution containing the undissolved residue passed through the passages to the dissolving tank and a pipeline for leading the filtrate to the recovery tank.

A method of dissolving a nickel metal, which has a specific surface of 0.003 $m^2/g$ or more, is dissolved with the use of the above-described apparatus.

12 Claims, 2 Drawing Sheets

APPARATUS FOR CONTINUOUSLY DISSOLVING METAL POWDER FOR USE IN PLATING AND METHOD OF DISSOLVING NICKEL METAL USING SAME

BACKGROUND OF THE INVENTION

1. Field of the Invention

The present invention relates to an apparatus for manufacturing a plated steel sheet, and more particularly, to an apparatus for continuously dissolving metal powder for use in plating to supply a plating solution continuously to an electrolytic tank used for electroplating a steel sheet, and a method of dissolving metal powder using the apparatus.

2. Description of the Related Art

Conventionally, there have been two methods for replenishing metal ions consumed in a plating bath when various types of metals are electroplated on the surface of a metal sheet such as a steel sheet. One is a method in which an anode comprised of a plating metal is immersed into a plating bath, which is an electrolytic tank to dissolve the anode and to replenish the metal ions. The other is a method in which an insoluble anode is immersed into the plating bath, and the metal ions are fed to the plating bath from a dissolving device which is otherwise provided separately.

In the former method, however, the anode is consumed by the passage of electric current through the electrolytic tank and the operation of replenishing the metal ions is often interrupted due to an anode exchange operation, thereby causing a number of disadvantages from an operation viewpoint. For this reason, the latter method using the insoluble anode has been a mainstream recently.

Thus, research and development with respect to a method of or an apparatus for dissolving the metal ions is being increasingly carried out. Since a technique for separating/recovering metal powder (such as zinc powder, nickel powder, ion powder or the like) in the plating bath is a key factor in the above method and apparatus, a number of techniques using a press filter, a cyclone, a centrifugal separator, a leaf filter and the combination thereof have been disclosed.

In Japanese Unexamined Patent Publication No. 6-41796, there is disclosed an apparatus for continuously dissolving a plating metal (a metal to be plated) which comprises a dissolving tank of the plating metal, a cyclone for separating undissolved residue of the plating metal and a plating solution, a pump and a pipeline, and a technique for increasing a yield of using the plating metal by connecting the dissolving tank and the cyclone with a circuit to circulate the plating solution containing the undissolved residue. In Japanese Unexamined Patent Publication No. 5-33199, there is disclosed a technique for passing the plating solution containing the undissolved residue of the metal powder through a leaf filter having a pre-coated layer formed on the filter fabric thereof by mixing a filter aid into the plating solution so as to improve filtering efficiency. Furthermore, various suggestions concerning a dissolving tank or the like employing a press filter or a centrifugal separator as a filter have been made.

However, a technique using a press filter or a leaf filter as the filter has the following problems. A dissolving operation should be paused to discharge the undissolved metal powder deposited on a filter fabric after filtering out of the system. When the undissolved metal powder is disposed of, unit requirement (yield) of the metal powder is deteriorated. In order to reuse the undissolved metal powder, an additional operation is required for recovering and transferring the metal powder to the dissolving tank. On the other hand, a technique using a cyclone or a centrifugal separator as the filter has the following problem. According to this technique, the particle diameter of the metal powder to be collected 100% is 30 μm or more. Thus, when the metal powder is dissolved to have the particle diameter of 30 μm or less, or when the metal powder having the particle diameter is used for improving the dissolving ability, the undissolved metal powder is mixed into the plating solution to bring about deterioration of quality of the plating unless a secondary filter (leaf filter or the like) is used in combination with the primary filter to separate the plating solution and the undissolved metal powder. Furthermore, when nickel is used as metal powder particularly in zinc-nickel plating, there is a problem that the dissolving rate of the nickel is not necessarily sufficient from a viewpoint of practical use.

SUMMARY OF THE INVENTION

It is an object of the present invention to provide an apparatus for continuously dissolving the metal powder for use in plating with a high dissolving yield which can avoid the mixing of the metal powder into the plating solution.

It is another object of the present invention to provide specific conditions of using the apparatus when nickel is used as the metal powder in zinc-nickel plating.

According to an aspect of the present invention, there is provided an apparatus for continuously dissolving metal powder for use in plating, comprising:

- a dissolving tank for dissolving metal powder used in a plating solution in a solvent;
- a filter for separating the solution containing the undissolved residue into an undissolved residue and a filtrate;
- a recovery tank of the filtrate; and
- a plating solution storing tank for supplying recovered filtrate to a plating tank, wherein the filter is a porous substance having a plurality of liquid passages in the axial direction thereof, and the filter is provided with a circuit for returning a liquid containing the undissolved residue passed through the passages to the dissolving tank and a pipeline for leading the filtrate to the recovery tank.

According to another aspect of the present invention, there is provided a method of dissolving a nickel metal, wherein nickel metal having a specific surface of 0.003 $m^2/g$ or more is used as the metal powder and dissolved under the condition of the solvent having a temperature of 75° to 100° C.

DESCRIPTION OF THE PREFERRED EMBODIMENTS

The present invention will be specifically described by way of example with reference to the accompanying drawings.

Figure 1:
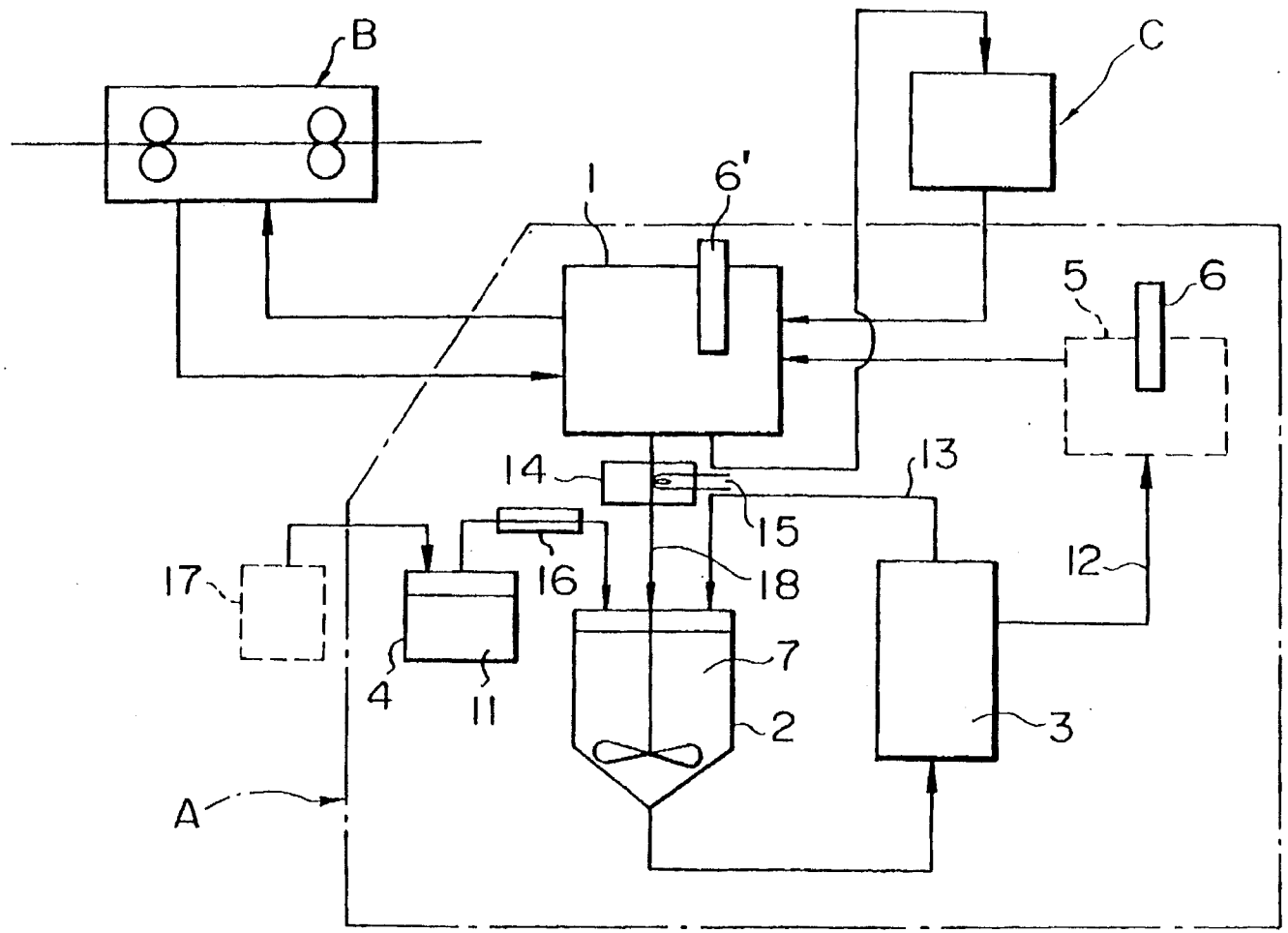
FIG. 1 is a block diagram showing the entire plating system including an apparatus for dissolving metal powder for use in plating according to the present invention.

FIG. 1 is a block diagram showing the entire plating system including an apparatus for dissolving metal powder for use in plating according to the present invention.

The dissolving operation of the metal powder with the dissolving apparatus of the present invention is performed as follows.

Referring to FIG. 1, there are shown a dissolving apparatus A, a plating device B and a dissolving device C for dissolving other metal, for example, zinc.

On the whole, in this embodiment, nickel is dissolved by the dissolving apparatus A, zinc is dissolved by the dissolving device C and a liquid produced thereby is fed into a plating solution storing device 1 so that the liquid has a predetermined concentration. Further, a predetermined amount of the plating solution having a predetermined concentration is fed to the plating device B. The remaining plating solution is recovered from the plating device B to the plating solution storing tank 1 to be reused.

In the apparatus A, metal powder 11 is fed from a hopper 4, storing the powder, to a dissolving tank 2 by a nickel feeding device 16. A metal powder grinding device 17 may be provided upstream of the hopper 4, so that the particle size (specific surface) of the metal is adjusted for accelerating a metal dissolving operation.

Figure 2:
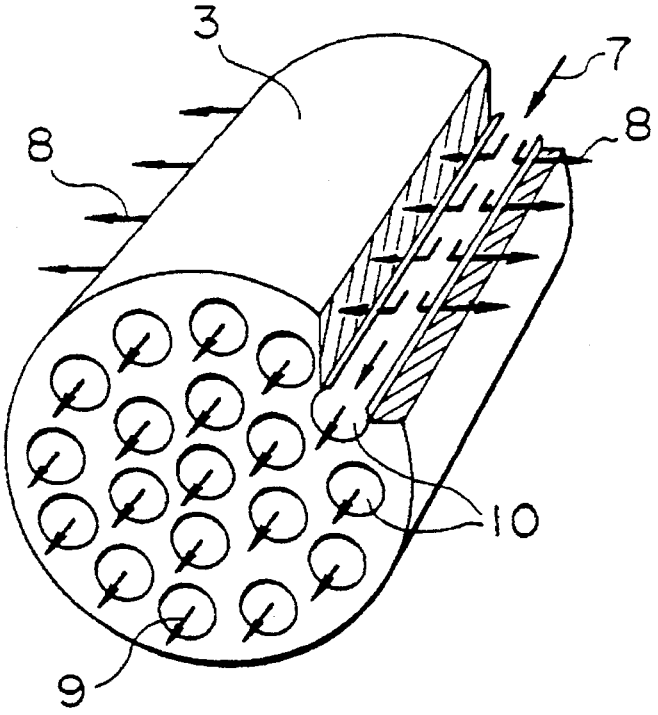
FIG. 2 is a view showing details of a filter used in the dissolving apparatus according to the present invention.

The metal powder fed to the dissolving tank 2 is dissolved by a plating solution which is otherwise fed separately as a solvent from the plating solution storing tank 1. At this time, the undissolved residual metal powder is passed together with the plating solution 7 through a plurality of passages (lumens) which penetrate through a filter 3 in the axial direction as shown in FIG. 2, and returned again to the dissolving tank 2 by way of a circuit 13. In the meantime, a filtrate (plating solution) 8 filtered by a porous substance of the filter 3 is fed to the plating solution storing tank 1 by way of a pipeline 12 and a filtrate recovery tank 5 (may be omitted). Numerical 9 shows stream of liquid which contains undissolved residue.

The amount of plating solution in the dissolving tank 2 is replenished from the plating solution storing tank I as to compensate reduced amount of plating solution 8. At this time, a plating solution temperature-rise device 14 may be provided in a flow-back path 18 between the plating solution storing tank 1 and the dissolving tank 2, so as to control the temperature of the plating solution (solvent) to a predetermined temperature by a heater 15 or the like. A temperature 75° to 100° C. is preferably used to get a greater dissolving rate.

In the system of the present invention, the metal powder 11 is fed from the hopper 4 by way of the nickel feeding device 16 with calculating the amount of reduction of the metal powder using a gravimeter (not shown) provided in the dissolving tank 2. At least one of plating solution densitometers 6, 6' is provided in the plating solution storing tank 1 or the filtrate recovery tank 5.

In this embodiment, MILLIPORE CERAFLO (trade name; manufactured by Nippon Millipore Corp.; material: alumina) is used as the filter 3. The specifications of the MILLIPORE CERAFLO including a filtering condition are shown in Table 1.

TABLE 1

| Name | MILLIPORE, CERAFLO |
|---|---|
| Material | 99.6%, alumina |
| Routine | |
| Inner Diameter | 2.7 mm |
| Number | 19 lumen/element |

TABLE 1-continued

| Name | MILLIPORE, CERAFLO |
|---|---|
| Membrane area | 0.135 $m^2$ |
| Section area of opening | 1.088 $cm^2$ |
| Flow rate | 6.5–65 liter/min |
| Filtering ability | 0.2 μm or more |
| Available temperature | 0° C.–120° C. |
| Allowable pH range | 1–14 |

Using the filtering device shown in Table 1, nickel is continuously fed and dissolved with the use of 20 to 50 g/l of zinc ions, 50 to 100 g/l of nickel ions, and sulfuric acid solution of pH 1 to 2 with adjusting a temperature of the solution to 75° to 100° C., and a feed rate of the plating solution to 100 to 1,000 l/min.

Nickel powder for use in plating is used with a feed rate of 1 to 2 kg/min. Approximately 100% of the metal powder could be recovered with the use of an alumina filter having a filter mesh of 0.2 μm as the filtering device, and no trouble due to the mixing of the metal powder into the plating solution occurred.

Since the filter 3 is an alumina ceramic filter, it was not corroded by the plating solution of a high temperature (40° to 100° C.) and low pH (1 to 3) plating solution.

When the plating solution is sufficiently stirred by increasing the flow rate of the plating solution circulating in the system, the dissolving tank 2 may be omitted.

Next, in order to compare the effect of the apparatus of the present invention in which the ceramic filter is used with that of the conventional apparatuses in which various filters are used, the dissolving and filtering tests were carried out. The results are summarized in Table 2. The yield of the metal powder was 100% and it is apparent from Table 2 that the results obtained from the apparatus of the present invention are superior to those of the conventional apparatuses.

That is to say, when the apparatus of the present invention is used, even the metal powder having the particle diameter of 100 μm, even 30 μm or less can be recovered, thereby increasing the yield of the raw material of the metal powder. In addition, substantially no metal powder is suspended or contained in the plating solution (filtrate), thereby improving the quality of the resultant metal plating.

Figure 3:
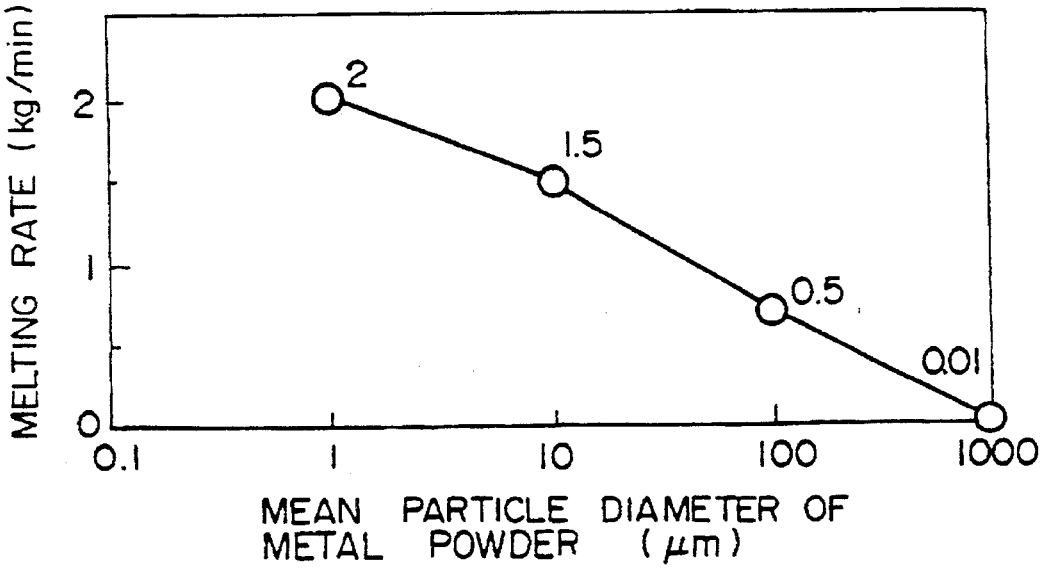
FIG. 3 is a graph showing the dissolving test results of metal powder by the dissolving apparatus according to the present invention.

Furthermore, as shown in FIG. 3, the dissolving rate of the metal powder can be increased from the conventional rate of 0.01 kg/min to 0.5 to 2.0 kg/min.

TABLE 2

| Type of filter | Metal powder yield (recovery %) | Content in filtrate | Note |
|---|---|---|---|
| Cyclone only | 48 | 52 | Poder of particle diameter of 30 μm or less not collected |
| Leaf filter only | 25 (Melted during depositing on filter fabric) | 2 | Remaining 73 deposited on filter fabric |
| Cyclone (primary) + Leaf filter (secondary) | Cyclone 48 + Leaf filter 12 | 1 | Remaining 39 deposited on fabric of leaf filter |
| Ceramic filter | 100 | 0 | |

As regards the particle size of the metal powder, the following sizes are found to be preferable for sufficiently increasing the dissolving rate:

Mean particle diameter is less than 100 μm when the metal powder is spherical in shape; and Mean particle diameter is less than 150 μm when the metal powder is non-spherical in shape.

In other words, the specific surface of the metal powder is preferably 0.003 $m^2$ or more. In order to obtain the above particle size (specific surface), the metal powder may be ground in advance with the grinding device 17.

The temperature of the solution may be preferably set to 75° to 100° C. Conventionally, the plating solution having a temperature of 55° to 65° C. has been used. However, as a result of dissolving experiment using the apparatus of the present invention and nickel powder having the specific surface of 0.003 $m^2/g$ or less, it is found that the above temperature is required to obtain a sufficient dissolving rate for the nickel-zinc plating.

In order to satisfy such temperature condition as described above, FRP (fiber reinforced plastic), titanium or a stainless steel may be preferably used for a material of a dissolving tank in the apparatus of the present invention.

In one form of the present invention, there is provided an apparatus for continuously dissolving metal powder for use in plating, comprising: a dissolving tank for dissolving metal powder used in plating solution in a solvent; a filter separating the solution containing the undissolved residue into an undissolved residue and a filtrate; a recovery tank of the filtrate; and a plating solution storing tank for supplying recovered filtrate to a plating tank, wherein the filter is a porous substance having a plurality of liquid passages in the axial direction thereof, and the filter is provided with a circuit for returning a liquid containing the undissolved residue passed through the passages to the dissolving tank and a pipeline for leading the filtrate to the recovery tank. This feature of the invention offers the following advantage. The liquid solution containing the undissolved residue is circulated between the filter and the dissolving tank, and the metal powder is not discharged out of the system. As a result, the metal powder can be dissolved and the yield becomes approximately 100%.

In an another form of the present invention, there is provided an apparatus for continuously dissolving metal powder for use in plating, wherein the porous substance is an alumina ceramic material. This feature of the invention offers the following advantages. Mixing of the undissolved residue into the plating solution can be avoided and the particle diameter of the metal powder can be substantially reduced. Thus, the dissolving rate of the metal powder is increased to perform dissolving operation efficiently.

According to the present invention, the dissolving condition of nickel is specifically determined when nickel is used as the metal powder in zinc-nickel plating. Therefore, dissolving of nickel for plating at high speed can be performed at extremely high efficiency.

Moreover, according to the present invention, nickel metal is directly dissolved. This is more economical than a case where nickel salt is used. In addition to this, adverse effects of sodium, calcium or the like mixed into the plating solution from metallic salts can be avoided.

What is claimed is:

1. An apparatus for continuously dissolving nickel metal powder for use in plating, comprising:

a dissolving tank for dissolving nickel metal powder used in a plating solution in a solvent;

filtering means for separating a liquid into an undissolved residue and a recovered filtrate;

a recovery tank for holding said recovered filtrate; and a plating solution storing tank for supplying said recovered filtrate to the dissolving tank, wherein said filtering means is a porous substance having a plurality of liquid passages in an axial direction thereof, and said filtering means is provided with a circuit for returning the liquid solution containing the undissolved residue passed through said passages to said dissolving tank and a pipeline for leading the filtrate to said recovery tank.

2. An apparatus for continuously dissolving nickel metal powder for use in plating according to claim 1, wherein said porous substance is an alumina ceramic material.

3. An apparatus for continuously dissolving nickel metal powder for use in plating according to claim 2, further comprising:

a hopper connected to the dissolving tank; and a grinder, connected to the hopper, for grinding the metal powder.

4. An apparatus for continuously dissolving nickel metal powder for use in plating according to claim 2, wherein the nickel metal powder is a nickel metal having a mean particle size not greater than 30 μm, and wherein the solvent has a temperature of 75° to 100° C.

5. An apparatus for continuously dissolving nickel metal powder for use in plating according to claim 1, further comprising:

a hopper connected to the dissolving tank; and a grinder, connected to the hopper, for grinding the metal powder.

6. An apparatus for continuously dissolving nickel metal powder for use in plating according to claim 5, wherein the metal powder is a nickel metal having a mean particle size not greater than 30 μm, and wherein the solvent has a temperature of 75° to 100° C.

7. An apparatus for continuously dissolving nickel metal powder for use in a plating according to claim 1, wherein the nickel metal powder is a nickel metal having a mean particle size not greater than 30 μm, and wherein the solvent has a temperature of 75° to 100° C.

8. An apparatus for continuously dissolving nickel metal powder, comprising:

a dissolving tank for dissolving nickel metal powder;

a filter separating a solvent, received from the dissolving tank, into an undissolved residue and a recovered filtrate, wherein said filter is a porous substance having a plurality of liquid passages in an axial direction thereof, and wherein said filter is provided with a circuit for returning the liquid containing the undissolved residue passed through said liquid passages to said dissolving tank; and a plating solution storing tank receiving recovered filtrate from the filter and supplying said recovered filtrate to the dissolving tank.

9. An apparatus for continuously dissolving nickel metal powder for use in plating according to claim 8, wherein said filter is provided with a pipeline for transferring the recovered filtrate to the plating solution storage tank by way of a recovery tank.

10. An apparatus for continuously dissolving nickel metal powder comprising:

a recovering tank;

a dissolving tank for dissolving nickel metal powder;

a filter for separating a liquid, received from said dissolving tank, into an undissolved residue and a recovered filtrate, wherein said filter returns the undissolved residue to said dissolving tank and returns said recovered filtrate to said recovery tank.

11. A method for continuously dissolving nickel metal powder for use in plating, comprising the steps of:

dissolving nickel metal powder used in a plating solution in a solvent in a dissolving tank;

filtering a liquid, received from said dissolving tank, into an undissolved residue and a recovered filtrate utilizing a filter;

supplying said recovered filtrate to a plating solution storing tank; and returning said undissolved residue to said dissolving tank.

12. A method for continuously dissolving nickel melting metal powder for use in plating according to claim 11, wherein the recovered filtrate is supplied to the plating solution storing tank by way of a recovery tank.

* * * * *